US007448121B1

(12) United States Patent
Hung

(10) Patent No.: US 7,448,121 B1
(45) Date of Patent: Nov. 11, 2008

(54) METAL HAND TOOL AND METHOD FOR MANUFACTURING THE SAME

(75) Inventor: Chiu-Yuea Hung, Taiping (TW)

(73) Assignee: Jin Xiang Kai Industry Co., Ltd., Taichung (TW)

( * ) Notice: Subject to any disclaimer, the term of this patent is extended or adjusted under 35 U.S.C. 154(b) by 0 days.

(21) Appl. No.: 11/787,536

(22) Filed: Apr. 17, 2007

(51) Int. Cl.
*B25B 13/06* (2006.01)

(52) U.S. Cl. ..... 29/56.5; 29/402.18; 29/460; 29/527.2; 29/270; 81/121.1; 81/119; 204/194; 205/80

(58) Field of Classification Search ..... 29/56.5, 29/270, 620, 402.18, 460, 527.2, DIG. 12; 204/193, 194; 205/80, 87, 93, 117, 118, 205/122, 143, 149, 151; 81/52, 119, 121.1
See application file for complete search history.

(56) References Cited

U.S. PATENT DOCUMENTS 3,658,663 A * 4/1972 Fukanuma et al. ..... 205/118
5,277,785 A * 1/1994 Van Anglen ..... 205/117
5,897,762 A * 4/1999 Liu ..... 205/196
6,363,606 B1 * 4/2002 Johnson et al. ..... 29/854
6,490,950 B2 * 12/2002 Ray et al. ..... 76/119
6,634,082 B1 * 10/2003 Ziegler et al. ..... 29/597
6,761,093 B2 * 7/2004 Chang ..... 81/121.1
6,912,937 B2 * 7/2005 Tuanmu ..... 81/119
7,010,998 B2 * 3/2006 Ying-Hao ..... 81/121.1
2005/0154567 A1 * 7/2005 Jackman et al. ..... 703/2

* cited by examiner

*Primary Examiner*—Dana Ross
(74) *Attorney, Agent, or Firm*—Banger Shia

(57) ABSTRACT

A metal hand tool is fabricated by a method to manufacture the metal hand tool, and the metal hand tool has a body with an outer surface and a preparing region, a printing layer with a mark and an electroplate layer. The method has a forming step, a printing step and an electroplating step. In the preparing step, the body is made of metal. In the printing step, the printing layer is printed on the preparing region in the outer surface of the body and the mark is enchased on the printing layer with an external surface. In the electroplating step, the electroplate layer is electroplated on the external surface of the mark and the outer surface of the body except the preparing region with the printing layer to complete the metal hand tool.

7 Claims, 3 Drawing Sheets

METAL HAND TOOL AND METHOD FOR MANUFACTURING THE SAME

BACKGROUND OF THE INVENTION

1. Field of the Invention

The present invention relates to a hand tool, and more particularly relates to a metal hand tool and a method to manufacture the metal hand tool.

2. Description of the Related Art

Metal hand tools such as socket bits, wrenches, ratchet wrenches and screwdrivers are used frequently in our lives. A mark with drawings or words is manufactured on the metal hand tool to show the trademark and the standards of the metal hand tool.

In the past, there were two conventional methods for manufacturing the mark on the metal hand tool comprising forming a salient or an indent as the mark when casting the metal hand tool, and then electroplating the metal hand tool with an electroplate layer. However, the metal hand tool is electroplated with the same color, and this cannot let users see the mark obviously and clearly.

The second method for manufacturing the mark on the metal hand tool comprises electroplating the metal hand tool after casting the metal hand tool, and then printing a layer with multiple colors on the metal hand tool to function as the mark. This method can let users see the mark obviously and clearly. However, the printing layer cannot be mounted securely around the electroplate layer and this may make the printing layer falling from the metal hand tool. In addition, the printing layer may fall off when rubbing the metal hand tool.

Therefore, the present invention provides a metal hand tool and a method to manufacture the metal hand tool to mitigate or obviate the aforementioned problems.

SUMMARY OF THE INVENTION

The main objective of the present invention is to provide a metal hand tool and a method to manufacture the metal hand tool.

A metal hand tool in accordance with the present invention is fabricated by a method to manufacture the metal hand tool, and the metal hand tool has a body with an outer surface and a preparing region, a printing layer with a mark and an electroplate layer.

The method to manufacture the metal hand tool in accordance with the present invention comprises a forming step, a printing step and an electroplating step. In the preparing step, the body is made of metal. In the printing step, the printing layer is printed on the preparing region in the outer surface of the body and the mark is enchased on the printing layer with an external surface. In the electroplating step, the electroplate layer is electroplated on the external surface of the mark and the outer surface of the body except the preparing region with the printing layer to complete the metal hand tool.

Other objectives, advantages and novel features of the invention will become apparent from the following detailed description when taken in conjunction with the accompanying drawings.

DETAILED DESCRIPTION OF THE PREFERRED EMBODIMENT

Figure 1:
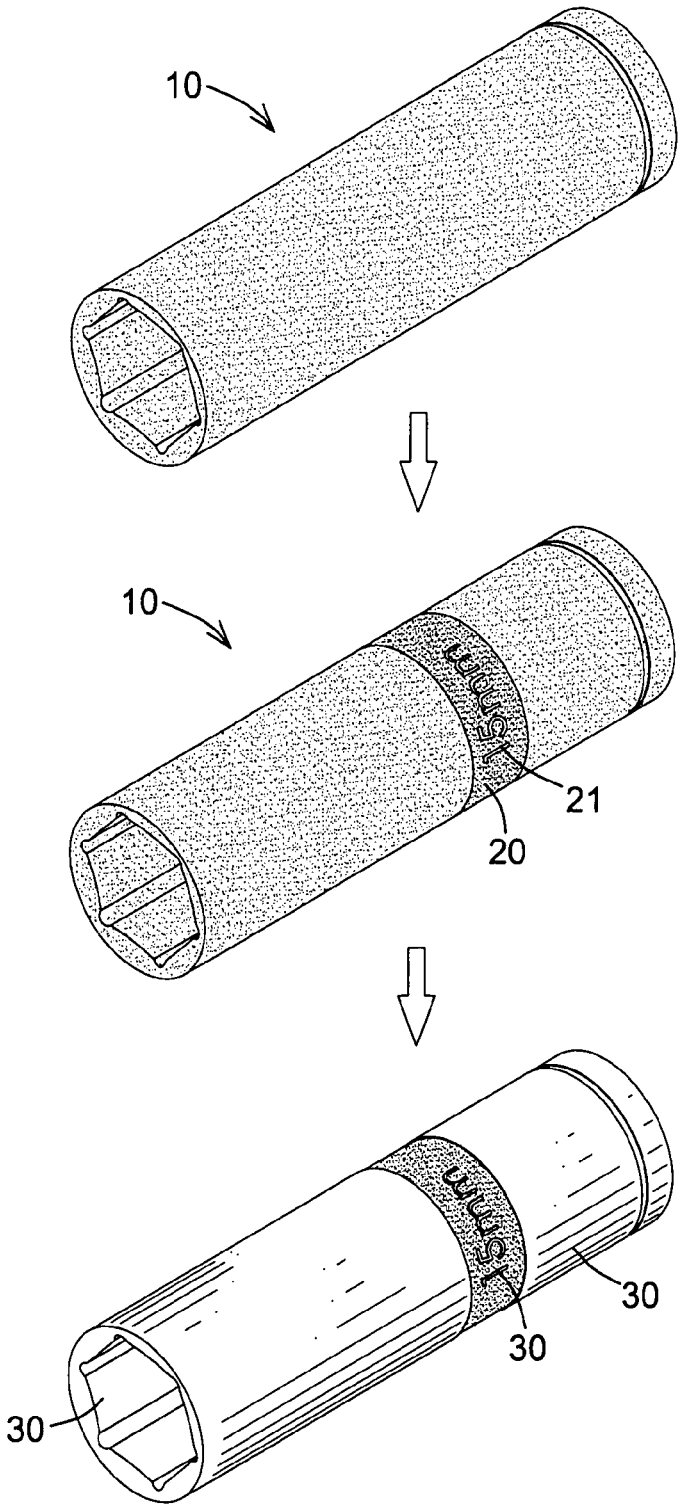
FIG. 1 is a perspective view of manufacturing a metal hand tool in accordance with the present invention.
Figure 2:
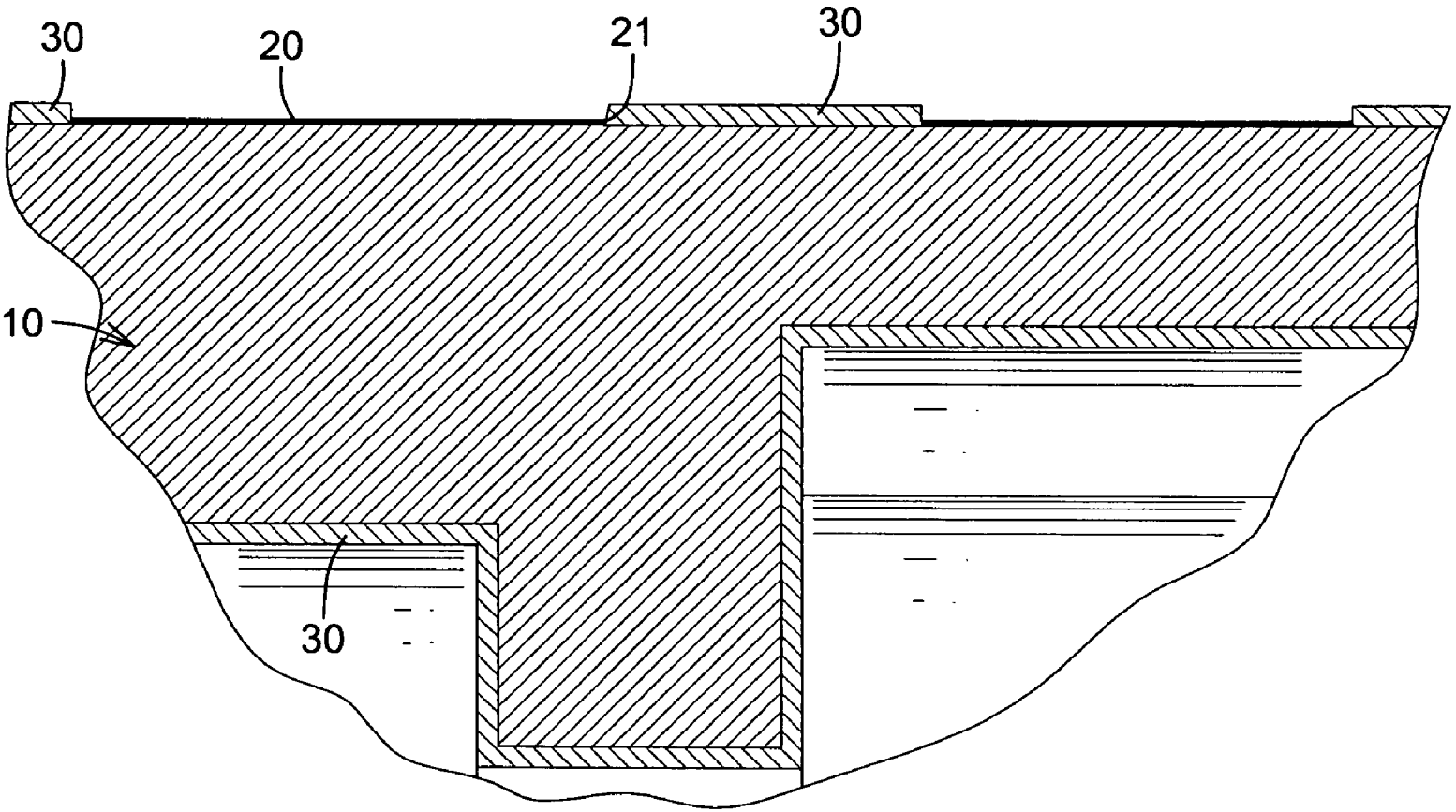
FIG. 2 is an enlarged cross section side view of the metal hand tool in FIG. 1.
Figure 3:
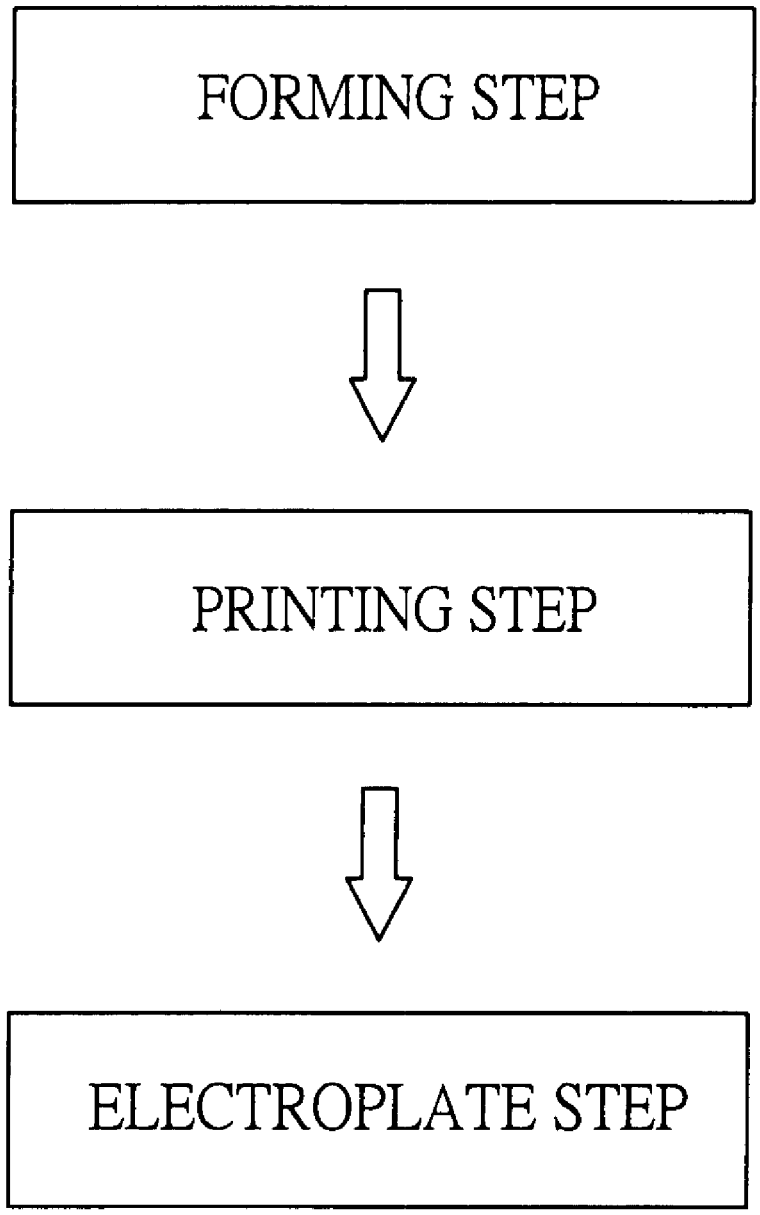
FIG. 3 is a block diagram of manufacturing the metal hand tool in FIG. 1.

With reference to FIGS. 1 to 3, a metal hand tool in accordance with the present invention is made by a method in accordance with the present invention for manufacturing the metal hand tool.

The metal hand tool is made of metal and comprises a body (10), a printing layer (20) and an electroplate layer (30).

The body (10) is made by casting or forging and has an outer surface and a preparing region. The preparing region is defined on the outer surface of the body (10).

The printing layer (20) is printed on the preparing region in the outer surface of the body (10) with a single color or multiple colors and has a mark (21). The mark (21) is enchased on the printing layer (20) by the single color or the multiple colors and has an external surface.

The electroplate layer (30) is electroplated on the external surface of the mark (21) and the outer surface of the body (10) except the preparing region with the printing layer (20) to protect the metal hand tool. In addition, the electroplate layer (30) can be a single layer or multiple layers. The mark (21) can present a three-dimensional effect when the electroplate layer (30) is electroplated with multiple layers.

The method for manufacturing the metal hand tool comprise (a) a forming step, (b) a printing step and (c) an electroplating step.

The forming step comprises manufacturing the body (10) with an outer surface and a preparing region by casting or forging.

The printing step comprises printing single color or multiple colors on the preparing region in the outer surface of the body (10) to form a printing layer (20) and enchasing a mark (21) with an external surface on the printing layer (20).

The electroplating step comprises electroplating an electroplate layer (30) on the external surface of the mark (21) and the outer surface of the body (10) except the preparing region with the printing layer (20) to complete the metal hand tool.

The metal hand tool and the method to manufacture the metal hand tool have the following advantages.

1. The electroplate layer (30) is electroplated on the external surface of the mark (21) and the outer surface of the body (10) except the preparing region with the printing layer (20) to protect the metal hand tool. This can let users see the mark obviously and clearly.

2. The printing layer (20) is printed securely around the outer surface of the body (10) and this can prevent the printing layer (20) from falling from the metal hand tool.

3. The mark (21) can present a three-dimensional effect when the electroplate layer (30) is electroplated with multiple layers.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad genera meaning of the terms in which the appended claims are expressed.

What is claimed is:

1. A metal hand tool being made of metal and comprising:

a body having an outer surface; and a preparing region defined on the outer surface of the body;

a printing layer printed on the preparing region in the outer surface of the body and having a mark enchased on the printing layer with an external surface; and an electroplate layer electroplated on the external surface of the mark and the outer surface of the body except the preparing region with the printing layer.

2. A method for manufacturing a metal hand tool that has a body with an outer surface and a preparing region, a printing layer with a mark and an electroplate layer, and the method comprising:

(a) a forming step comprising forming the body with the outer surface and the preparing region;

(b) a printing step comprising printing the printing layer on the preparing region in the outer surface of the body; and enchasing the mark with an external surface on the printing layer; and (c) an electroplating step comprising electroplating the electroplate layer on the external surface of the mark and the outer surface of the body except the preparing region with the printing layer to complete the metal hand tool.

3. The method for manufacturing a metal hand tool as claimed in claim 2, wherein the printing layer has a single color.

4. The method for manufacturing a metal hand tool as claimed in claim 3, wherein the electroplate layer has multiple layers.

5. The method for manufacturing a metal hand tool as claimed in claim 2, wherein the printing layer has multiple colors.

6. The method for manufacturing a metal hand tool as claimed in claim 5, wherein the electroplate layer has multiple layers.

7. The method for manufacturing a metal hand tool as claimed in claim 2, wherein the electroplate layer has multiple layers.

* * * * *